US008359717B2

(12) United States Patent
Yamamoto et al.

(10) Patent No.: US 8,359,717 B2
(45) Date of Patent: Jan. 29, 2013

(54) SLIDE FASTENER

(75) Inventors: Kentaro Yamamoto, Macon, GA (US); Hisashi Yoneshima, Macon, GA (US); Shigeyoshi Takazawa, Anaheim, CA (US)

(73) Assignee: YKK Corporation

( * ) Notice: Subject to any disclaimer, the term of this patent is extended or adjusted under 35 U.S.C. 154(b) by 623 days.

(21) Appl. No.: 12/477,773

(22) Filed: Jun. 3, 2009

(65) Prior Publication Data

US 2009/0320250 A1 Dec. 31, 2009

Related U.S. Application Data

(63) Continuation-in-part of application No. 12/164,659, filed on Jun. 30, 2008.

(51) Int. Cl.
*A44B 19/02* (2006.01)
*A44B 19/04* (2006.01)

(52) U.S. Cl. ..... 24/411; 24/403; 24/585.1

(58) Field of Classification Search ..... 24/403, 24/381, 409, 410, 411, 413, 414, 584.1, 585.1, 24/585.11
See application file for complete search history.

(56) References Cited

U.S. PATENT DOCUMENTS

| | | | | |
|---|---|---|---|---|
| 2,157,828 | A * | 5/1939 | Kuna | 24/409 |
| 2,371,591 | A * | 3/1945 | Cizek | 24/410 |
| 3,874,038 | A * | 4/1975 | Takamatsu | 24/413 |
| 4,502,190 | A * | 3/1985 | Inamura | 24/389 |
| 4,513,483 | A * | 4/1985 | Kasai | 24/409 |
| 4,520,535 | A * | 6/1985 | Kasai | 24/410 |
| 4,765,038 | A * | 8/1988 | Kasai | 24/389 |
| 6,105,214 | A | 8/2000 | Press | |
| 7,337,508 | B2 * | 3/2008 | Takasawa et al. | 24/401 |
| 7,353,570 | B2 * | 4/2008 | Himi | 24/405 |
| D628,123 | S * | 11/2010 | Kojima et al. | D11/221 |
| D632,218 | S * | 2/2011 | Yamamoto et al. | D11/221 |
| D657,287 | S * | 4/2012 | Cheng | D11/221 |
| 2004/0187277 | A1 * | 9/2004 | Akashi et al. | 24/584.1 |
| 2006/0207069 | A1 * | 9/2006 | Cheng | 24/389 |
| 2006/0260104 | A1 * | 11/2006 | Himi | 24/403 |

FOREIGN PATENT DOCUMENTS

| | | |
|---|---|---|
| JP | 45-33956 | 12/1970 |
| JP | 59-42893 | 12/1984 |
| JP | Y2 63-13687 | 4/1998 |

OTHER PUBLICATIONS

Office Action dated May 5, 2011, U.S. Appl. No. 12/164,659.

* cited by examiner

*Primary Examiner* — Robert J Sandy
*Assistant Examiner* — Tyler Johnson
(74) *Attorney, Agent, or Firm* — Alston & Bird LLP

(57) ABSTRACT

Various embodiments of slide fasteners include a first set of coupling elements and a second set of coupling elements configured to be removably joined together by a slider. Each coupling element includes a first surface having a first shape and a second surface having a second shape, wherein the second surface is spaced apart from and cofaces the first surface. The first shape may be substantially triangular or substantially trapezoidal, according to various embodiments, and the second shape is substantially gear shaped. When the coupling elements of the first set and the second set are removably joined together, water is substantially prevented from leaking from the first surface to the second surface. In addition, the coupling elements are disposed on stringer tapes, and the surfaces of the stringer tapes adjacent the first surfaces of the coupling elements are laminated with a water resistant material.

21 Claims, 9 Drawing Sheets

SLIDE FASTENER

CROSS-REFERENCE TO RELATED APPLICATIONS

This patent application is a continuation-in-part patent application of U.S. application Ser. No. 12/164,659 entitled "SLIDE FASTENER" and filed Jun. 30, 2008, which is herein incorporated by reference in its entirety.

BACKGROUND OF THE INVENTION

Typically, water resistant slide fasteners include coil coupling elements that are attached to stringer tapes. However, zippers used with the coil coupling elements tend to stick and become difficult to operate at lower temperatures, making them unsuitable for use with outdoor clothing that may be worn in low temperature environments. In addition, these zippers become difficult to operate when exposed to sand, debris, or ice.

Plastic molded coupling elements are not as susceptible to sticking at lower temperatures or when exposed to sand, debris, or ice, but known plastic molded coupling elements do not repel water effectively.

Accordingly, there is a need in the art for an improved slide fastener that is water resistant.

BRIEF SUMMARY OF VARIOUS EMBODIMENTS OF THE INVENTION

Various embodiments of the invention provide a plurality of coupling elements for use with a slide fastener. Each of the coupling elements includes a first base portion, a second base portion, an engaging portion, and a front face. The first base portion is disposed adjacent a first surface of a stringer tape, and the second base portion is disposed adjacent a second surface of the stringer tape, wherein the first surface of the stringer tape is opposite the second surface of the stringer tape. In addition, the first base portion and the second base portion define a channel therebetween for receiving a longitudinal edge of the stringer tape.

The engaging portion extends outwardly from the first and the second base portions, and the engaging portion includes a first surface and a second surface. The first surface of the engaging portion is opposite and spaced apart from the second surface of the engaging portion. The first surface of the engaging portion has a first shape, and the second surface of the engaging portion has a second shape. A portion of the second shape adjacent a distal end of the engaging portion has a width dimension that is greater than a width dimension of a portion of the first shape adjacent the distal end. Each of the width dimensions are measured in a direction substantially parallel with the longitudinal edge of the stringer tape.

The front face is disposed at the distal end of the engaging portion and extends between the first and the second surface thereof.

A first set of coupling elements are disposed on a first stringer tape, and a second set of coupling elements are disposed on a second stringer tape. A first gap is defined by the first surfaces of the engaging portions of two adjacent coupling elements in the second set, and a second gap is defined by the second surfaces of the engaging portions of the two adjacent coupling elements in the second set. In addition, a third gap is defined by the first surfaces of the engaging portions of two adjacent coupling elements in the first set, and a fourth gap is defined by the second surfaces of the engaging portions of the two adjacent coupling elements in the first set.

When the first set of coupling elements are removably joined together with the second set of coupling elements, the first surface of the engaging portion of a first coupling element in the first set is at least partially disposed within the first gap, and the second surface of the engaging portion of the first coupling element is at least partially disposed within the second gap. In addition, the first surface of the engaging portion of a second coupling element in the second set is at least partially disposed within the third gap, and the second surface of the engaging portion of the second coupling element is at least partially disposed within the fourth gap. Furthermore, the front face of the first coupling element is disposed adjacent and cofaces the longitudinal edge of the second stringer tape, and the front face of the second coupling element is disposed adjacent and cofaces the longitudinal edge of the first stringer tape.

Various embodiments of a slide fastener may include coupling elements such as those described above. In a particular embodiment, the first surfaces of the first and the second stringer tapes are laminated with a liquid resistant material. In addition, in one embodiment, the coupling elements are molded from a plastic material.

According to various embodiments, the first shape includes a substantially trapezoidal shaped distal end portion and a substantially trapezoidal shaped intermediate portion. The distal end portion is disposed adjacent the distal end of the engaging potion, and the intermediate portion is disposed between the distal end portion and the first base portion. Furthermore, a width of a base of the intermediate portion is greater than a width of a base of the distal end portion. In addition, in certain embodiments, the second shape comprises a neck portion and a head portion. The head portion is adjacent the distal end of the engaging portion, and the neck portion is disposed between the second base portion and the head portion. A width of the neck portion is less than a width of the head portion, and the width of the head portion is greater than a width of the distal end portion. When the first set of coupling elements are removably joined together with the second set of coupling elements, the distal end portion of the first coupling element is disposed between the intermediate portions of the two adjacent coupling elements in the second set, and the distal end portion of the second coupling element is disposed between the intermediate portions of the two adjacent coupling elements in the first set. In addition, in certain embodiments, the head portion of the first coupling element is disposed between the neck portions of the two adjacent coupling elements in the second set, and the head portion of the second coupling element is disposed between the neck portions of the two adjacent coupling elements in the first set.

In various embodiments, a width of a first surface of the first base portion is greater than a width of a second surface of the second base portion, wherein the first surface of the first base portion is spaced above and apart from the first surface of the stringer tape and the second surface of the second base portion is spaced above and apart from the second surface of the stringer tape. In a further embodiment, the first and second base portions include side surfaces, and the side surfaces extend outwardly from the first surface and second surface of the first and second base portions, respectively, toward the first and second surfaces of the stringer tapes, respectively, at an angle relative to a vertical axis that extends substantially perpendicular to the first surface and the second surface of the stringer tape. The angle at which the side surfaces of the first base portion extend is smaller than the angle at which the side surfaces of the second base portion extend.

According to various embodiments, the engaging portion of each coupling element includes a sealing portion and a fastening portion that abut each other at an interface. The sealing portion extends between the first surface of the engaging portion and the interface, and the fastening portion extends between the second surface of the engaging portion and the interface. In addition, the sealing portion includes first and second engaging faces that each extend between the first surface of the engaging portion and the interface, and the fastening portion includes first and second fastening faces that each extend between the second surface of the engaging portion and the interface. The fastening portion further includes an interface surface that is opposite and spaced apart from the second surface of the engaging portion, and the interface surface defines a first groove and a second groove that extend downwardly from said interface surface in a direction substantially toward said second surface of the engaging portion. The first groove is disposed adjacent and extends substantially along at least a portion of the first engaging face of the sealing portion, and the second groove is disposed adjacent and extends substantially along at least a portion of the second engaging face of the sealing portion.

When the coupling elements disposed on first and second stringer tapes are removably joined together, the intermediate portion of the coupling elements on the first stringer tape are generally disposed between adjacent distal end portions of the coupling elements on the second stringer tape and vice versa. Thus, when the stringer tapes are bent such that the first surfaces of the engaging portions of the coupling elements on each stringer tape are moved closer together, the intermediate portions of the coupling elements on the first stringer tape that are within the bending radius of the stringer tapes engage the grooves defined on the interface surface of the coupling elements disposed on the second stringer tape that are within the bending radius of the stringer tapes.

Furthermore, according to certain embodiments, the fastening portion of each coupling element includes first and second chamfered surfaces. The first chamfered surface extends between the interface surface and the first fastening face, and the second chamfered surface extends between the interface surface and the second fastening face.

BRIEF DESCRIPTION OF THE DRAWINGS

Figure 1B:
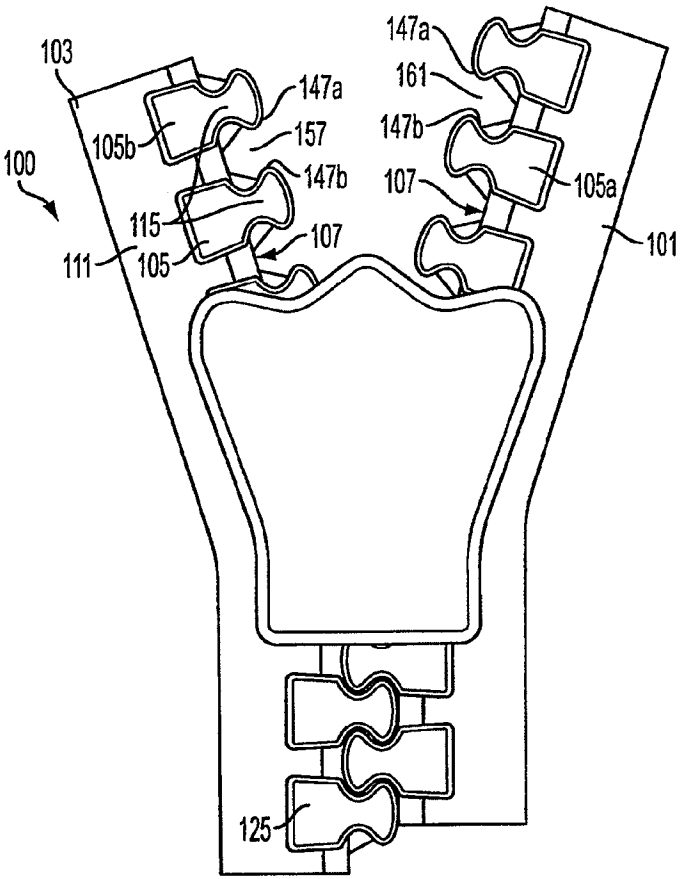
Figure 1A:
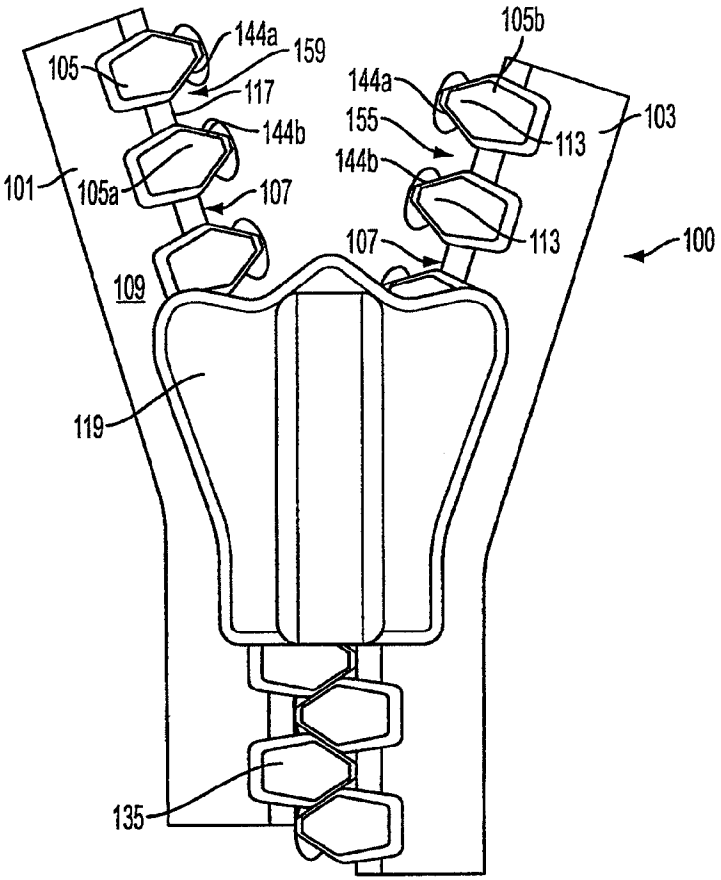

Having thus described various embodiments of the invention in general terms, reference will now be made to the accompanying drawings, which are not necessarily drawn to scale, and wherein:

FIG. 1A illustrates a plan view of a first surface of a slide fastener according to one embodiment of the invention.

FIG. 1B illustrates a plan view of a second surface of the slide fastener shown in FIG. 1A.

Figure 2A:
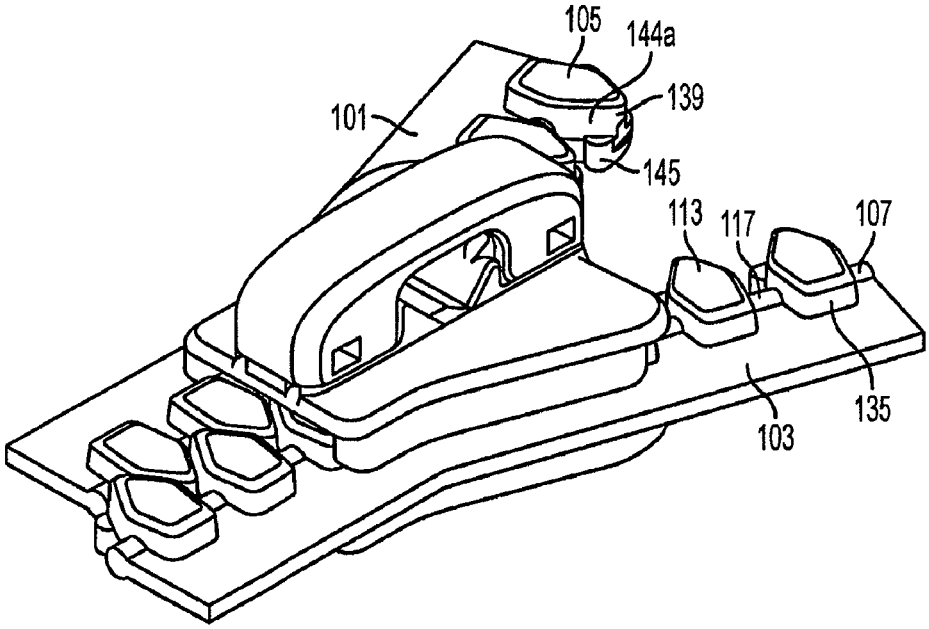

FIG. 2A illustrates a perspective view of the first surface of the slide fastener shown in FIG. 1A.

Figure 2B:
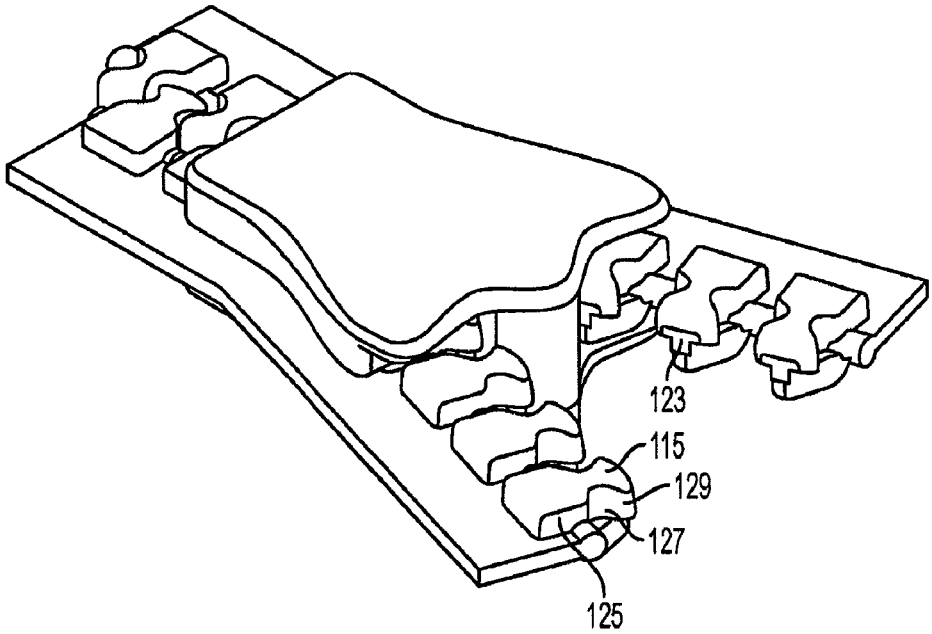

FIG. 2B illustrates a perspective view of the second surface of the slide fastener shown in FIG. 1A.

Figure 3C:
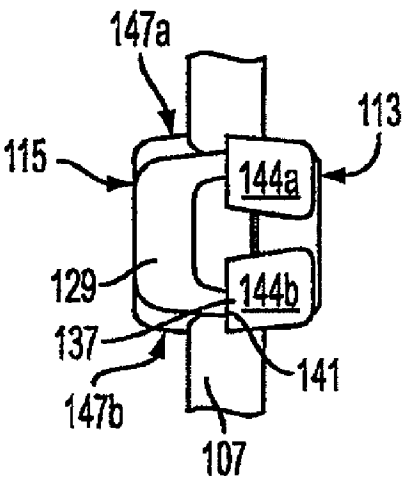
Figure 3B:
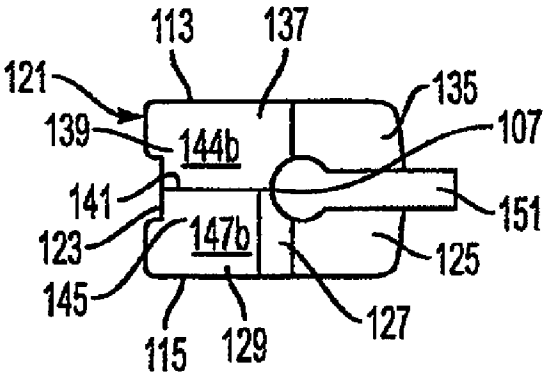
Figure 3A:
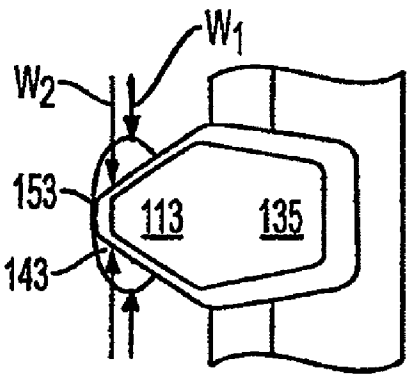

FIG. 3A illustrates a partial plan view of a coupling element molded to the first surface of the slide fastener shown in FIG. 1A.

FIG. 3B illustrates a side view of the coupling element shown in FIG. 3A.

FIG. 3C illustrates an end view of the coupling element shown in FIG. 3A.

Figure 4B:
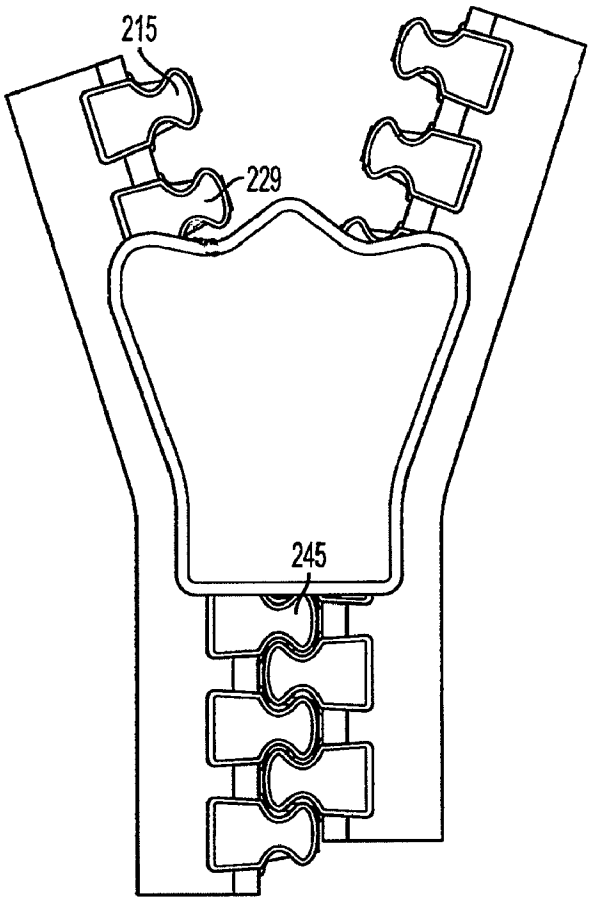
Figure 4A:
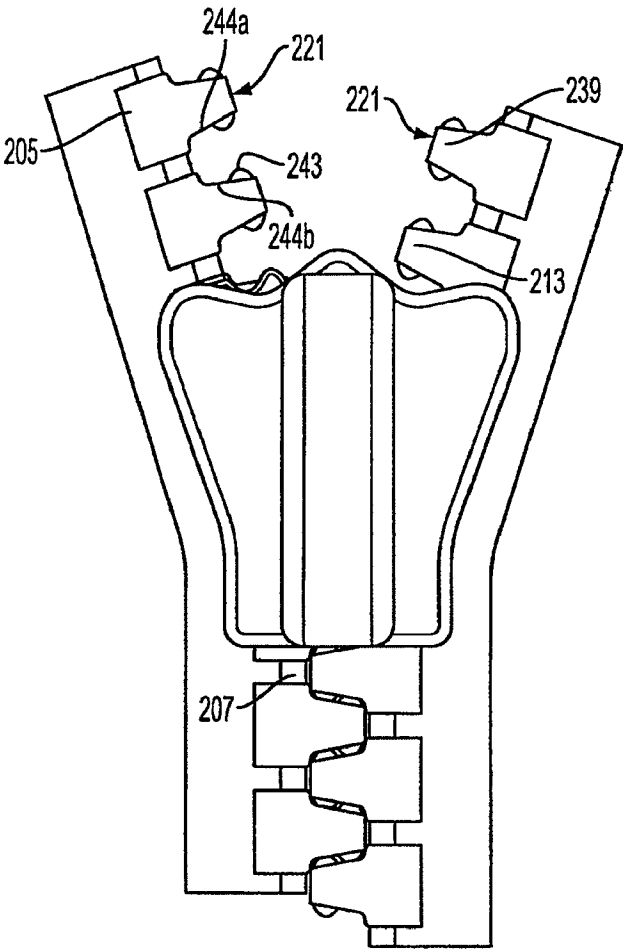

FIG. 4A illustrates a plan view of a first surface of a slide fastener according to another embodiment of the invention.

FIG. 4B illustrates a plan view of a second surface of the slide fastener shown in FIG. 4A.

Figure 5A:
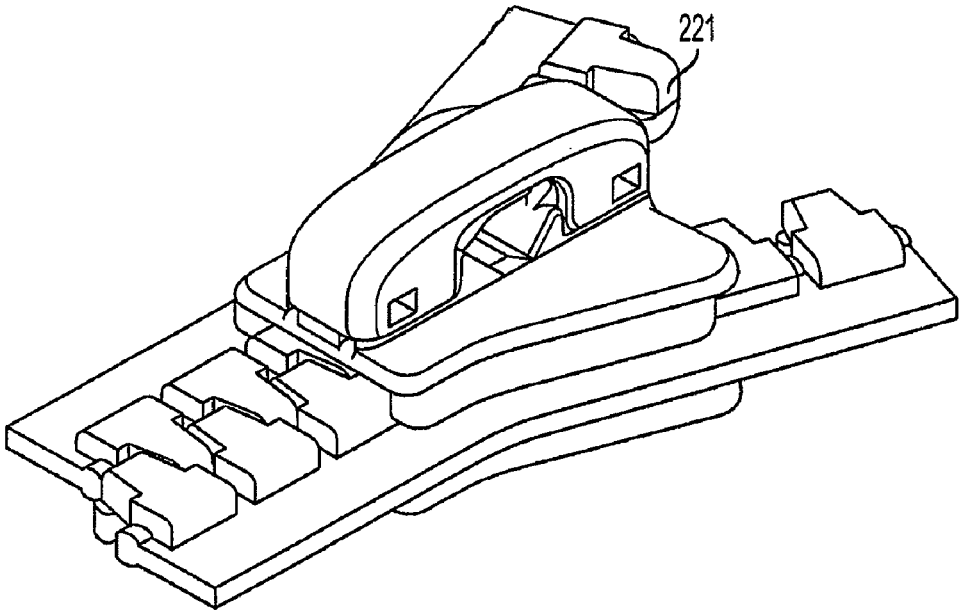

FIG. 5A illustrates a perspective view of the first surface of the slide fastener shown in FIG. 4A.

Figure 5B:
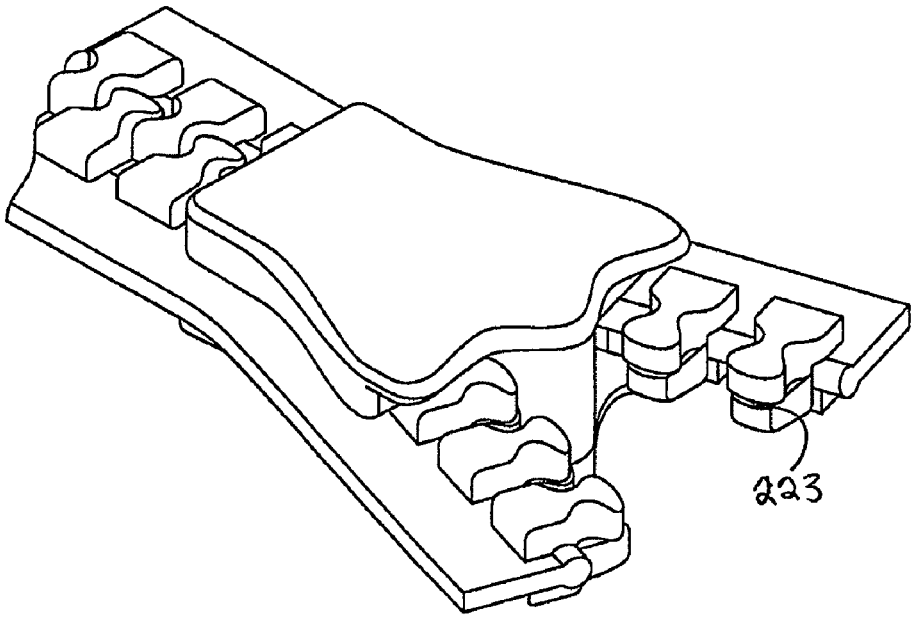
Figure 6B:
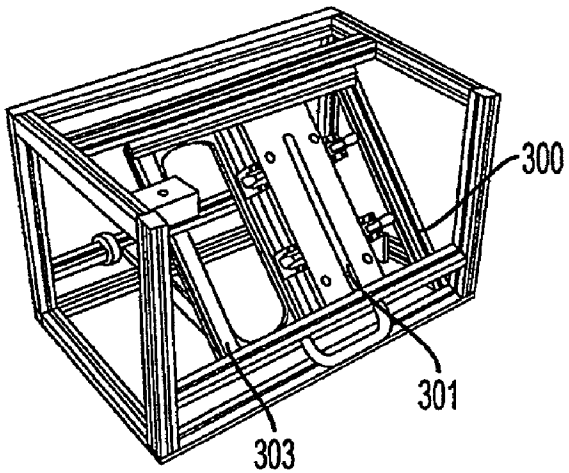
Figure 6A:
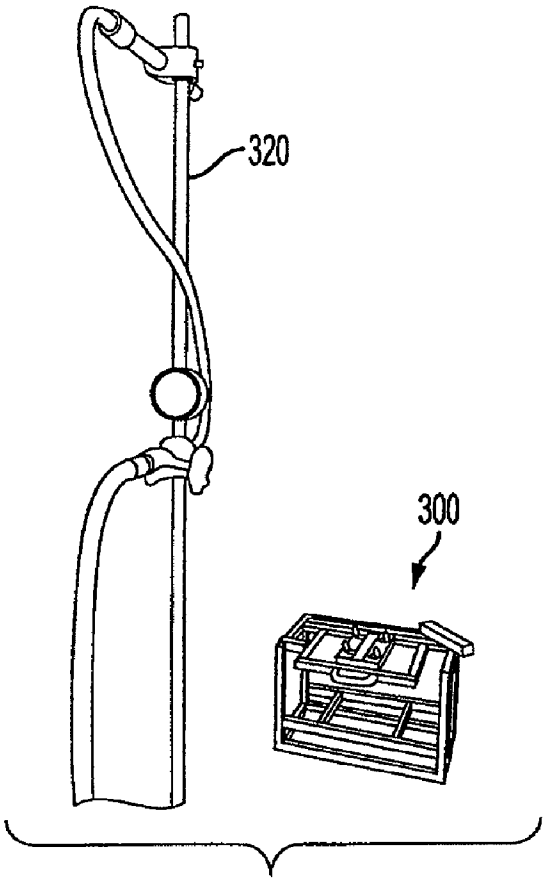
Figure 6D:
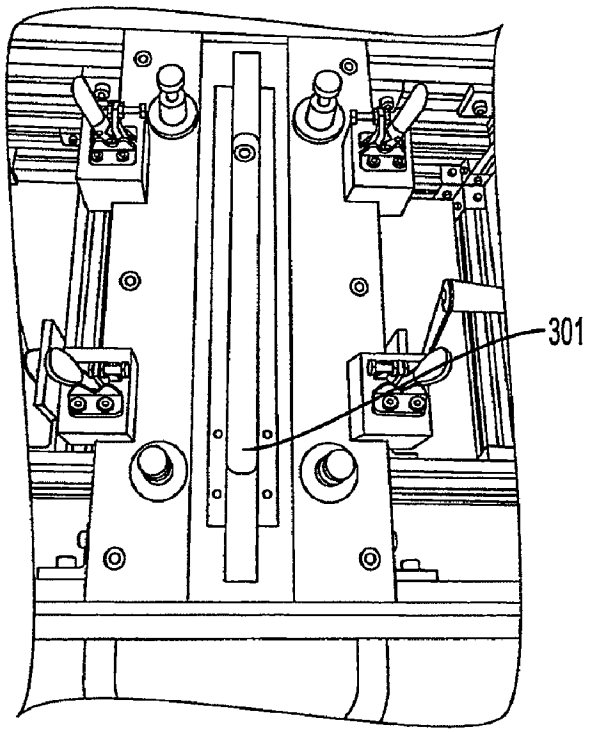
Figure 6C:
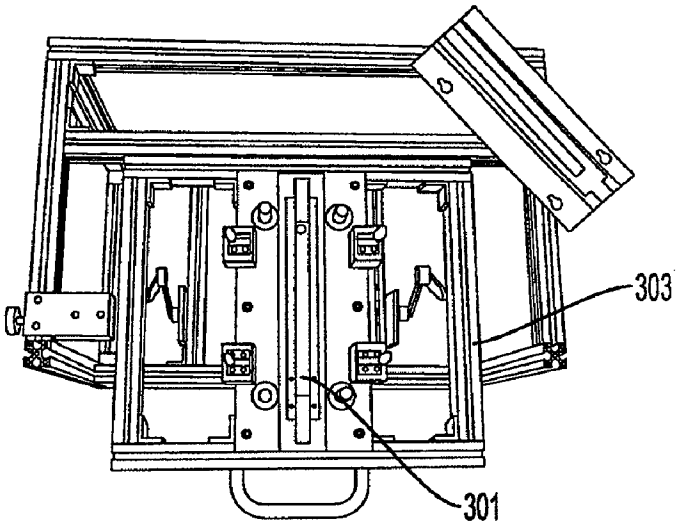

FIG. 5B illustrates a perspective view of the second surface of the slide fastener shown in FIG. 4A.

FIGS. 6A-6D illustrate exemplary test equipment for testing the water repellency of the slide fasteners shown in FIGS. 1A-5B.

Figure 7B:
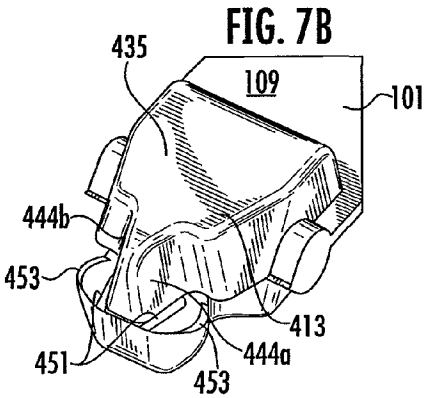
Figure 7A:
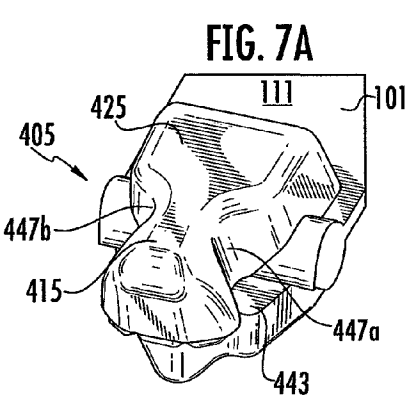

FIGS. 7A and 7B illustrate perspective views of opposite sides of a coupling element according to an alternative embodiment.

Figure 8:
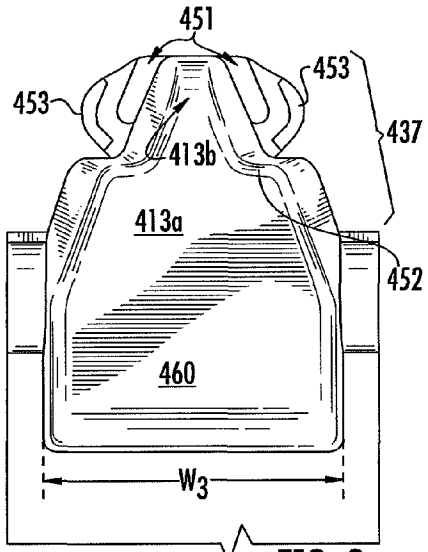

FIG. 8 illustrates a plan view of the first surface of the coupling element shown in FIGS. 7A and 7B.

Figure 9:
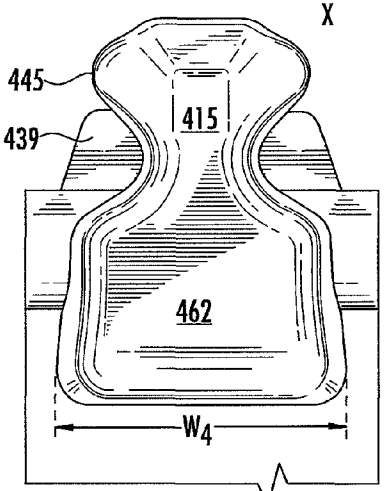

FIG. 9 illustrates a plan view of the second surface of the coupling element shown in FIGS. 7A and 7B.

Figure 10:
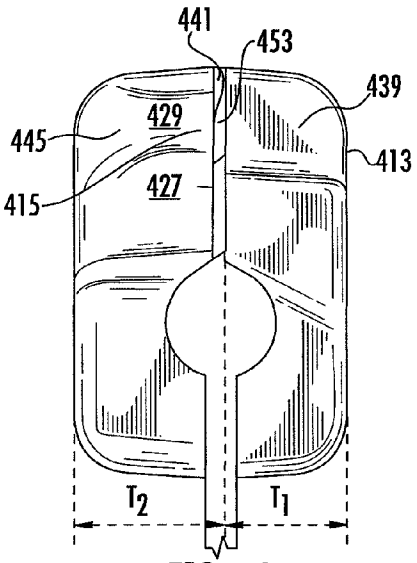

FIG. 10 illustrates a side view of the coupling element shown in FIGS. 7A and 7B.

Figure 11:
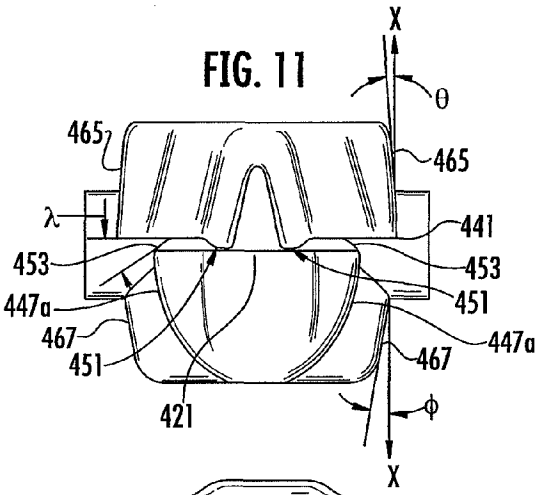

FIG. 11 illustrates an end view of the coupling element shown in FIGS. 7A and 7B.

Figure 12:
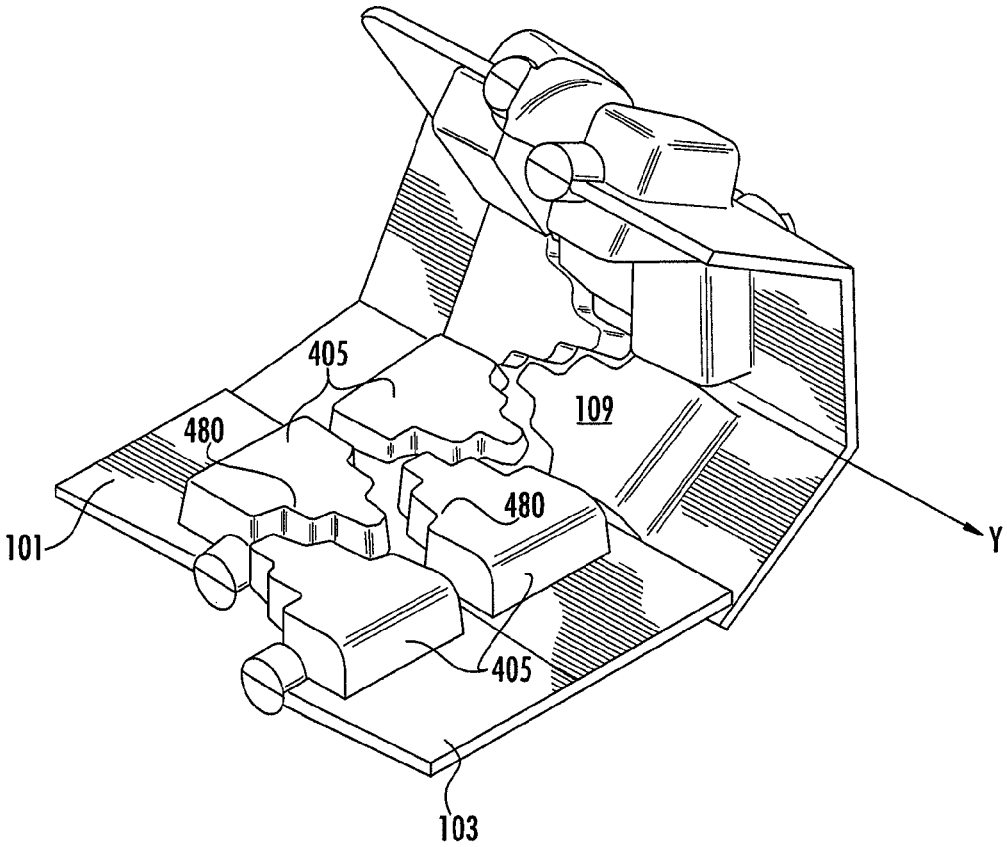

FIG. 12 illustrates multiple coupling elements according to the alternative embodiment shown in FIGS. 7A and 7B disposed on a pair of fastener tapes and bent around a lateral axis extending through the fastener tapes.

DETAILED DESCRIPTION OF VARIOUS EMBODIMENTS OF THE INVENTION

Various embodiments of the invention are described more fully hereinafter with reference to the accompanying drawings, in which some, but not all embodiments of the invention are shown in the figures. These inventions may be embodied in many different forms and should not be construed as limited to the embodiments set forth herein. Rather, these embodiments are provided so that this disclosure will satisfy applicable legal requirements.

A slide fastener according to various embodiments is shown in FIGS. 1A, 1B, 2A, and 2B. The slide fastener 100 includes a first set of coupling elements 105 disposed on a first stringer tape 101 and a second set of coupling elements 105 disposed on a second stringer tape 103. The stringer tapes 101, 103 each include a first surface 109 and a second surface 111 that are opposite each other.

Each coupling element 105 includes a first base portion 135, a second base portion 125, an engaging portion 137, and a front face 121. The first base portion 135 is disposed adjacent the first surface 109 of the stringer tape 101, 103, and the second base portion 125 is disposed adjacent the second surface 111 of the stringer tape 101, 103. In addition, the first base portion 135 and the second base portion 125 define a channel 151 therebetween for receiving a longitudinal edge 107 of the stringer tape 101, 103.

The engaging portion 137 extends outwardly from the first 135 and the second base portions 125 and includes a first surface 113 and a second surface 115. The first surface 113 of the engaging portion 137 is spaced apart from and cofaces the second surface 115 of the engaging portion 137. The first surface 113 of the engaging portion 137 has a first shape and is disposed adjacent the first surface 109 of the stringer tape 101, 103, and the second surface 115 of the engaging portion 137 has a second shape and is disposed adjacent the second surface 111 of the stringer tape 101, 103. A portion of the second surface 115 of the engaging portion 137 adjacent a distal end 153 of the engaging portion 137 has a width dimension W1 that is greater than a width dimension W2 of a portion of the first surface 113 of the engaging portion 137 adjacent the distal end 153. The width dimensions are measured in a width plane that is substantially parallel to the first surface 113 and the second surface 115 of the engaging portion 137. In the embodiment shown in FIGS. 1A-3C, the first shape of the first surface 113 is substantially triangular as viewed from the first surface 109 of the stringer tape 101, 103, and the second shape of the second surface 115 is substantially gear shaped as viewed from the second surface 111 of the stringer tape 101, 103.

In the embodiment shown in FIGS. 1A-3C, the engaging portion 137 includes a sealing portion 139 and a fastening portion 145, and the sealing portion 139 and the fastening portion 145 abut each other at an interface 141. In particular, the sealing portion 139 extends between the first surface 113 and the interface 141, and the fastening portion 145 extends between the second surface 115 and the interface 141. In one embodiment, the interface 141 lies in a plane that is substantially parallel to the first surface 113 and the second surface 115.

As shown in FIGS. 1A and 3B-3C, the sealing portion 139 includes a first engaging face 144*a* and a second engaging face 144*b*. The first and second engaging faces 144*a*, 144*b* extend from the first surface 113 to the interface 141.

According to the embodiment shown in FIGS. 1B and 3B-3C, the fastening portion 145 includes a neck portion 127 and a head portion 129. The head portion 129 includes the front face 121, and the neck portion 127 is disposed between the second base portion 125 and the head portion 129. The neck portion 127 has a width dimension that is less than the width dimension of the head portion 129 and the second base portion 125. According to the embodiment shown in FIGS. 1A-3C, at least a portion 143 of the head portion 129 is wider in the width plane than the distal end 153 of the first surface 113 such that the portion 143 of the head portion 129 is visible when viewing the slide fastener 100 from the first side 109 of the stringer tapes 101, 103. In addition, a first fastening face 147*a* and a second fastening face 147*b* extend from the second surface 115 to the interface 141. Furthermore, the front face 121 is disposed at the distal end 153 of the engaging portion 137 and extends between the first 113 and the second surface 115 thereof.

A first gap 155 is defined by the first surfaces 113 and the engaging faces 144*a*, 144*b* of two adjacent coupling elements 105 in the second set, and a second gap 157 is defined by the second surfaces 115 and the fastening faces 147*a*, 147*b* of the two adjacent coupling elements 105 in the second set. In addition, a third gap 159 is defined by the first surfaces 113 and the engaging faces 144*a*, 144*b* of two adjacent coupling elements 105 in the first set, and a fourth gap 161 is defined by the second surfaces 115 and the fastening faces 147*a*, 147*b* of the two adjacent coupling elements 105 in the first set.

When the first set of coupling elements 105 are removably joined together with the second set of coupling elements 105, the first surface 113 of the engaging portion 137 and the sealing portion 139 of a first coupling element 105*a* in the first set are at least partially disposed within the first gap 155, and the second surface 115 of the engaging portion 137 and the fastening portion 145 of the first coupling element 105*a* are at least partially disposed within the second gap 157. In addition, the first surface 113 of the engaging portion 137 and the sealing portion 139 of a second coupling element 105*b* in the second set are at least partially disposed within the third gap 159, and the second surface 115 of the engaging portion 137 and the fastening portion 145 of the second coupling element 105*b* are at least partially disposed within the fourth gap 161. In particular, the head portions 129 of the coupling elements 105 in the first set are disposed between adjacent neck portions 127 of the coupling elements 105 in the second set, and the head portions 129 of the coupling elements 105 in the second set are disposed between adjacent neck portions 127 of the coupling elements 105 in the first set. The engagement of the head portions 129 between the neck portions 127 prevents the coupling elements 105 from inadvertently disengaging.

Furthermore, when the first set of coupling elements 105 are removably joined together with the second set of coupling elements 105, the front face 121 of the first coupling element 105*a* is disposed adjacent and cofaces the longitudinal edge 107 of the second stringer tape 103, and the front face 121 of the second coupling element 105*b* is disposed adjacent and cofaces the longitudinal edge 107 of the first stringer tape 101.

In a particular embodiment, such as shown in FIGS. 1A-3C, the engaging portions 137 of adjacent coupling elements 105 on the first stringer tape 101 are spaced apart from each other such that a portion 117 of the longitudinal edge 107 of the first stringer tape 101 is exposed between the adjacent coupling elements 105. Similarly, the engaging portions 137 of adjacent coupling elements 105 on the second stringer tape 103 are spaced apart from each other such that a portion 117 of the longitudinal edge 107 of the second stringer tape 103 is exposed between the adjacent coupling elements 105.

In addition, the first base portions 135 of the adjacent coupling elements 105 on the first coupling tape 101 may be spaced apart, and the second base portions 125 of the adjacent coupling elements 105 on the first coupling tape 101 may be spaced apart, as shown in the embodiment in FIGS. 1A-3C. Similarly, the first base portions 135 of the adjacent coupling elements 105 on the second coupling tape 103 may be spaced apart, and the second base portions 125 of the adjacent coupling elements 105 on the second coupling tape 103 may be spaced apart. However, in an alternative embodiment (not shown), the first 135 and second base portions 125 on each stringer tape 101, 103 may be formed continuously.

In addition, in the embodiment shown in FIGS. 3A and 3B, the front face 121 defines a channel 123 that is spaced apart from the channel 151 and is substantially parallel with the longitudinal edge 107. The channel 123 is configured for receiving the portion 117 of the longitudinal edge 107 of the opposite stringer tape 101, 103 when the coupling elements 105 on the stringer tapes 101, 103 are joined together.

According to various embodiments, each coupling element 105 is molded from a plastic material, such as polyester, polypropylene, polyethylene, or polyamide. However, in various other embodiments, the coupling elements may be formed of other materials, including, for example, metal, ceramic, or wood, or a combination thereof.

In addition, in one embodiment, the coupling elements 105 in the first set are molded to the first stringer tape 101, and the coupling elements 105 in the second set are molded to the second stringer tape 103. For example, in certain embodiments, the coupling elements 105 are molded to the stringer tapes 101, 103 using an injection molding process. In a further embodiment, holes (not shown) are defined along and adjacent to the longitudinal edges of the stringer tapes through which the molten material used in the injection molding process may pass for joining the base portions of each coupling element. In this embodiment, the holding force of the molten material on the stringer tapes is increased. In an alternative embodiment, the coupling elements may be formed separately and attached to the stringer tapes.

According to a particular embodiment, the first surface 109 of each stringer tape 101, 103 is laminated with a liquid resistant coating. The liquid resistant coating may include, for example, polyurethane, polyester, polypropylene, nylon, poly vinyl chloride, or another type of film. In addition, the first surface 109 of each stringer tape 101, 103 is laminated prior to molding the coupling elements 105 onto the stringer tapes 101, 103, according to a particular embodiment. However, in an alternative embodiment in which an ultra flexible and stretchable film is used in the lamination process, the lamination step may occur after the coupling elements 105 are molded to the stringer tapes 101, 103.

The stringer tapes 101, 103 are attached to an article having two seams to be joined together (e.g., clothing or bag) such that first surfaces 109 of stringer tapes 101, 103 and the first surfaces 113 of the coupling elements 105 are disposed adjacent an outside of the article and the second surfaces 111 of the stringer tapes 101, 103 and the second surfaces 115 of the coupling elements 105 are disposed adjacent an inside of the article. A slider 119 is urged over the coupling elements 105 in a first direction to join the coupling elements 105 on each stringer tape 101, 103 into engagement with each other, and the slider 119 is urged in a second direction opposite the first direction to disengage the coupling elements 105 on each stringer tape 101, 103.

In an alternative embodiment shown in FIGS. 4A-5B, the first shape of the first surface 213 of the engaging portion 239 is substantially trapezoidal as viewed from the first surface 109 of the stringer tape 101, 103. According to one embodiment, coupling elements (e.g., coupling elements 205) that have substantially trapezoidal shaped first surfaces (e.g., first surface 213) may provide better water repellency than coupling elements (e.g., coupling elements 105) that have substantially triangular first surfaces (e.g., first surface 113). However, coupling elements having substantially triangular first surfaces may provide more flexibility in the plane containing the stringer tapes 101, 103 than coupling elements having substantially trapezoidal first surfaces, according to one embodiment.

FIGS. 7A-11 illustrate a coupling element 405 according to another alternative embodiment. In particular, the coupling element 405 is similar to the coupling elements described above, but includes the following features: (1) a width W3 of a first surface 460 of the first base portion 435 is greater than a width W4 of a second surface 462 of the second base portion 425, wherein the first surface 460 spaced apart from and above the first surface 109 of the stringer tape 101, 103 and the second surface 462 is spaced apart from and above the second surface 111 of the stringer tape 101, 103; (2) the side surfaces 465 of the first base portion 435 extend outwardly from the first surface 460 toward the stringer tape 101, 103 at an angle Θ relative to a vertical axis X that extends substantially perpendicular to the first surface 109 and the second surface 111 of the stringer tape 101, 103, and the side surfaces 467 of the second base portion 425 extend outwardly from the second surface 462 toward the stringer tape 101, 103 at an angle Φ relative to the vertical axis X, wherein Θ is less than Φ; (3) a groove 451 is disposed adjacent each of the engaging faces 444*a*, 444*b* of the sealing portion 439, and the grooves 451 are defined on an interface surface 470 of the fastening portion 445, wherein the interface surface 470 is disposed substantially within the same plane as the interface 441; (4) a chamfered surface 453 that extends between the interface surface 470 and each of the first fastening face 447*a* and the second fastening face 447*b*; and (5) the shape of the first surface 413 of the engaging portion 437 includes a substantially trapezoidal shaped intermediate portion 413*a* and a substantially trapezoidal shaped distal end portion 413*b*, wherein the distal end portion 413*b* is adjacent the distal end 452 of the engaging portion 437, the intermediate portion 413*a* is between the distal end portion 413*b* and the first base portion 435, and a width of a base of the intermediate portion 413*a* is larger than a width of a base of the distal end portion 413*b*. Details regarding these features and exemplary advantages provided by the features according to various embodiments are described below.

FIGS. 8 and 9 illustrate the width W3 of the first surface 460 of the first base portion 435 and the width W4 of the second surface 462 of the second base portion 425, wherein the width is measured in a direction that extends substantially parallel to longitudinal edge of the stringer tapes 101, 103. In various embodiments, the width W3 is between about 5% and 30% greater than the width W4. In the embodiment shown in FIGS. 8 and 9, the width W3 is about 20% greater than the width W4.

FIG. 11 illustrates the angles Θ, Φ at which the side surfaces 465 of the first base portion 435 and the side surfaces 467 of the second base portion 425, respectively, slope relative to the vertical axis X. In various embodiments, the angle Θ is between about 1° and about 5°, and the angle Φ is between about 10° and about 30°. In the embodiment shown in FIG. 11, the angle Θ is about 5°, and the angle Φ is about 10°.

FIG. 12 shows the coupling elements 405 disposed on stringer tapes 101, 103 and removably joined together, according to one embodiment. When the stringer tapes 101, 103 are bent about a lateral axis Y extending through the stringer tapes 101, 103 such that the first surfaces 109 of the stringer tapes 101, 103 are bent toward each other, the additional width W3 of the first base portion 435 and the decreased slope Θ of the side surfaces 465 prevent the stringer tapes 101, 103 from bending below a certain bending radius. For example, in various embodiments, the minimum acceptable bending radius is greater than about 9 mm. According to various embodiments, keeping the stringer tapes 101, 103 from bending below the bending radius prevents inadvertent separation of the fastening portions 445 of mating coupling elements 405 through the bent portion of the stringer tapes 101, 103.

FIGS. 7B and 11 illustrate the groove 451 disposed adjacent each of the engaging faces 444*a*, 444*b* of the sealing portion 439 that is defined on the interface surface 470 of the fastening portion 445. In various embodiments, the groove has a width of at least about 0.3 mm and a depth of at least about 0.2 mm, wherein the depth direction is measured is a direction substantially parallel with the vertical axis X shown in FIG. 11. In the embodiment shown in FIGS. 7B and 11, the width of each groove 451 is about 0.3 mm, and the depth of each groove is about 0.2 mm.

The grooves 451 and the shape of the first surface 413 of the engaging portion 437 further increase the ability of the fastening portions 445 to maintain their engagement as the stringer tapes 101, 103 are bent, according to various embodiments. In particular, when the stringer tapes 101, 103 are bent as described above in relation to FIG. 12, at least a portion of the edge of each engaging face 444*a*, 444*b* adjacent the interface 441 engages the groove 451 next to the respective face 444*a*, 444*b*, which prevents the edges 480 from pressing against the interface surfaces 470 of fastening portions 445 and causing inadvertent disengagement of the fastening portions 445. In particular, in the embodiment shown in FIG. 12, the edges 480 of the intermediate portion 413*a* of each coupling element 405 engage the grooves 451 of the two adjacent coupling elements on the opposite stringer tape 101, 103. In addition, the narrowed width of the distal end portion 413*b* further reduces the interference between the distal end portions 413*b* of adjacent engaged coupling elements 405 as the stringer tapes 101, 103 are bent as shown in FIG. 12.

FIGS. 7B, 8, 10, and 11 illustrate the chamfered surface 453 that extends between the interface surface 470 and each of the first fastening face 447*a* and the second fastening face 447*b*. In particular, according to various embodiments, the chamfered surface 453 lies within a plane that is disposed at an angle λ of greater than about 0° and less than about 90° relative to the interface surface 470. In the embodiment shown in FIGS. 7B, 8, 10, and 11, the angle λ is about 45°. In various embodiments, the chamfered surfaces 453 on each coupling element 405 reduce the amount of force required to move the slider 119 over the coupling elements 405.

Furthermore, as shown in FIG. 10, a thickness T1 of the sealing portion 439 is less than a thickness T2 of the fastening portion 445. According to various embodiments, the thickness T2 of the fastening portion 445 is about 10% to 30% greater than the thickness T1 of the sealing portion 439. In the embodiment shown in FIG. 10, the thickness T2 is about 20% greater than the thickness T1. According to various embodiments, the increased thickness of the fastening portion 445 provides additional surface area for the fastening faces 447*a*, 447*b* to engage each other, which increases the horizontal pull strength of the coupling elements 405 when joined together.

The embodiments shown in FIGS. 1A-5B and 7A-12 are substantially water resistant. In particular, when the coupling elements 105, 205, 405 are engaged, liquids (e.g., water) are substantially prevented from leaking from the first surface 109 of each stringer tape 101, 103 and the first surface 113, 213, 413 of each coupling element 105, 205, 405 to the second surface 111 of each stringer tape 101, 103 and the second surface 115, 215, 415 of each coupling element 105, 205, 405. In particular, according to the embodiments shown in FIGS. 1A-5B, the liquid resistant coating on the first surfaces 109 of the stringer tapes 101, 103 substantially prevents liquids, such as water, from penetrating through the stringer tapes 101, 103. Liquids are also prevented from penetrating between adjacent coupling elements 105, 205, 405 disposed on opposite stringer tapes 101, 103 by the engagement of the engaging faces 144*a*, 144*b*, 244*a*, 244*b*, 444*a*, 444*b* of the sealing portions 139, 239, 439 of the coupling elements 105, 205, 405. In addition, liquid that may penetrate between adjacent engaging faces 144*a*, 144*b*, 244*a*, 244*b*, 444*a*, 444*b* of the coupling elements 105, 205, 405 is prevented from moving to the second surfaces 111 of the stringer tapes 101, 103 and the second surfaces of the 115, 215, 415 of the coupling elements 105, 205, 405 by the portion 143, 243, 443 of the head portion 129, 229, 429 adjacent the interface 141, 241, 441 between the sealing portion 139, 239, 439 and the fastening portion 145, 245, 445. Furthermore, in the embodiments shown in FIGS. 1A-5B, liquids are substantially prevented from penetrating through the interface between the front face 121, 221 of each coupling element 105, 205 and the longitudinal edge 107, 207 of the opposite stringer tape 101, 103 by the engagement of the channel 123, 223 with the portion 117 of the longitudinal edge 107 between adjacent engaging portions 137, 237.

The embodiment of the slide fasteners 100, 200, 400 shown in FIGS. 1A-5B and 7A-12 were subjected to a water repellency test, and the embodiments 100, 200 shown in FIGS. 1A-5B prevented less than 0.5 cubic centimeters (cc) of water per fifteen minutes from passing through the slide fasteners 100, 200. The embodiment 400 shown in FIGS. 7A-12 prevented less than 0.04 cc of water per fifteen minutes from passing through the slide fastener 400. In particular, as shown in FIGS. 6A-6D, the water repellency test included securing the slide fastener 100, 200, 400 to an opening 301 in a box 300 such that the first surface 109 of each stringer tape 101, 103 faced the outside of the box 300 and the second surface 111 of each stringer tape 101, 103 faced the inside of the box 300. The opening 301 was defined in a side face 303 of the box 300, and the side face 303 of the box 300 was disposed at an angle to a top surface of the box 300. A water source 320, such as a shower, was positioned adjacent the box 300 such that the water flowing from the water source 320 approached the side face 303 at substantially 45°. The water source 320 released water at a rate of approximately 100 mm/hour. After approximately fifteen minutes, the water inside the box 300 was measured to determine the ability of the slide fastener 100, 200 to repel water. As noted above, less than 0.5 cc of water passed through the slide fasteners 100, 200 during the test and less than 0.04 cc of water passed through the slide fastener 400 during the test.

CONCLUSION

Although this invention has been described in specific detail with reference to the disclosed embodiments, it will be understood that many variations and modifications may be effected within the spirit and scope of the invention as described in the appended claims.

The invention claimed is:

1. A plurality of coupling elements for use with a slide fastener, each of said coupling elements comprising:

a first base portion disposed adjacent a first surface of a stringer tape and a second base portion disposed adjacent a second surface of said stringer tape, said second surface of said stringer tape being opposite said first surface of said stringer tape, and said first base portion and said second base portion defining a channel therebetween for receiving a longitudinal edge of said stringer tape;

an engaging portion extending outwardly from said first and said second base portions, said engaging portion comprising a first surface and a second surface, said first surface of said engaging portion being opposite and spaced apart from said second surface of said engaging portion, and said first surface of said engaging portion having a first shape and said second surface of said engaging portion having a second shape, wherein a portion of said second surface of said engaging portion adjacent a distal end of said engaging portion has a width dimension that is greater than a width dimension of a portion of said first surface of said engaging portion adjacent said distal end, each of said width dimensions being measured in a direction substantially parallel with said longitudinal edge of said stringer tape; and wherein:

said first shape comprises a substantially trapezoidal shaped distal end portion and a substantially trapezoidal shaped intermediate portion, said distal end portion being disposed adjacent said distal end of said engaging portion and said intermediate portion being disposed between said distal end portion and said first base portion, and a width of a base of said intermediate portion is greater than a width of a base of said distal end portion and the intermediate portion includes (1) a first surface disposed on a first side of said distal end portion and extending in a direction substantially parallel with the stringer tape and (2) a second surface disposed on a second side of said distal end portion and extending in a direction substantially parallel with the stringer tape.

2. The coupling elements of claim 1 wherein:

each of said coupling elements further comprises a front face disposed at said distal end of said engaging portion, said front face extending between said first and said second surfaces of said engaging portion, a first set of coupling elements are disposed on a first stringer tape and a second set of coupling elements are disposed on a second stringer tape, a first gap is defined by said first surfaces of said engaging portions of two adjacent coupling elements in said second set, a second gap is defined by said second surfaces of said engaging portions of said two adjacent coupling elements in said second set, a third gap is defined by said first surfaces of said engaging portions of two adjacent coupling elements in said first set, a fourth gap is defined by said second surfaces of said engaging portions of said two adjacent coupling elements in said first set, when said first set of coupling elements are removably joined together with said second set of coupling elements, said first surface of said engaging portion of a first coupling element in said first set is at least partially disposed within said first gap and said second surface of said engaging portion of said first coupling element is at least partially disposed within said second gap, said first surface of said engaging portion of a second coupling element in said second set is at least partially disposed within said third gap and said second surface of said engaging portion of said second coupling element is at least partially disposed within said fourth gap, said distal end portion of said first coupling element is disposed between said intermediate portions of said two adjacent coupling elements in said second set and said distal end portion of said second coupling element is disposed between said intermediate portions of said two adjacent coupling elements in said first set, said front face of said first coupling element is disposed adjacent and cofacing said longitudinal edge of said second stringer tape, and said front face of said second coupling element is disposed adjacent and cofacing said longitudinal edge of said first stringer tape.

3. The coupling elements of claim 2 wherein:

said second shape comprises a neck portion and a head portion, wherein said head portion is adjacent said distal end of said engaging portion and said neck portion is disposed between said second base portion and said head portion, and wherein a width of said neck portion is less than a width of said head portion, and when said first set of coupling elements are removably joined together with said second set of coupling elements, said head portion of said first coupling element is disposed between said neck portions of said two adjacent coupling elements in said second set and said head portion of said second coupling element is disposed between said neck portions of said two adjacent coupling elements in said first set.

4. The coupling elements of claim 1 wherein:

said engaging portion comprises a sealing portion and a fastening portion, and said sealing portion and said fastening portion abut each other at an interface, wherein said sealing portion extends from said first surface of said engaging portion to said interface and said fastening portion extends from said second surface of said engaging portion to said interface, said sealing portion comprises a first engaging face and a second engaging face that each extend between said first surface of said engaging portion and said interface, and said fastening portion comprises a first fastening face and a second fastening face that each extend between said second surface of said engaging portion and said interface, and said fastening portion comprises an interface surface opposite and spaced apart from said second surface of said engaging portion, said interface surface defining a first groove and a second groove, each groove extending downwardly from said interface surface in a direction substantially toward said second surface of said engaging portion, wherein said first groove is disposed adjacent and extends substantially along at least a portion of said first engaging face of said sealing portion and said second groove is disposed adjacent and extends substantially along at least a portion of said second engaging face of said sealing portion.

5. The coupling elements of claim 1 wherein:

said engaging portion comprises a sealing portion and a fastening portion, and said sealing portion and said fastening portion abut each other at an interface, wherein said sealing portion extends from said first surface of said engaging portion to said interface and said fastening portion extends from said second surface of said engaging portion to said interface, and said sealing portion of said engaging portion has a first thickness as measured between said first surface of said engaging portion and said interface, said fastening portion of said engaging portion has a second thickness as measured between said second surface of said engaging portion and said interface, and said first thickness is less than said second thickness.

6. The coupling elements of claim 1 wherein said first base portion comprises a first base surface is spaced apart from and above said first surface of said stringer tape and said second surface of said second base portion is spaced apart from and above said second surface of said stringer tape, said first base surface having a first width and said second base surface having a second width, and said first width being greater than said second width, each of said width dimensions being measured in a direction substantially parallel with said longitudinal edge of said stringer tape.

7. The coupling elements of claim 1 wherein:

said first base portion comprises first and second side surfaces that extend between a first base surface and said first surface of said stringer tape, said first base surface being spaced apart from and above said first surface of said stringer tape, said second base portion comprises first and second side surfaces that extend between a second base surface and said second surface of said stringer tape, said second base surface being spaced apart from and above said second surface of said stringer tape, said first and second side surfaces of said first base portion extend outwardly from said first base surface toward said first surface of said stringer tape at a first angle and said first and second side surfaces of said second base portion extend outwardly from said second base surface toward said second surface of said stringer tape at a second angle, and said first angle is less than said second angle, wherein said first and second angles are measured relative to a vertical axis that extends substantially perpendicularly to said first and second surfaces of said stringer tape.

8. The coupling elements of claim 1 wherein:

said engaging portion comprises a sealing portion and a fastening portion, and said sealing portion and said fastening portion abut each other at an interface, wherein said sealing portion extends from said first surface of said engaging portion to said interface and said fastening portion extends from said second surface of said engaging portion to said interface, said sealing portion comprises a first engaging face and a second engaging face that each extend between said first surface of said engaging portion and said interface, and said fastening portion comprises a first fastening face and a second fastening face that each extend between said second surface of said engaging portion and said interface, said first and second fastening faces being spaced apart from each other, and said fastening portion comprises an interface surface that lies substantially within a plane that comprises said interface, and said fastening portion defines a first chamfered surface and a second chamfered surface, said first chamfered surface extending between said interface surface and said first fastening face and said second chamfered surface extending between said interface surface and said second fastening face.

9. A slide fastener comprising:

a first stringer tape and a second stringer tape, each stringer tape having a longitudinal edge, a first surface, and a second surface, said second surface being opposite said first surface;

a first set of coupling elements disposed adjacent said first stringer tape; and a second set of coupling elements disposed adjacent said second stringer tape, wherein each of said coupling elements comprises:

a first base portion disposed adjacent said first surface of said first or second stringer tape and a second base portion disposed adjacent said second surface of said first or second stringer tape, and said first base portion and said second base portion defining a channel therebetween for receiving said longitudinal edge of said first or second stringer tape, an engaging portion extending outwardly from said first and said second base portions, said engaging portion comprising a first surface and a second surface, said first surface of said engaging portion being opposite and spaced apart from said second surface of said engaging portion, and said first surface of said engaging portion having a first shape and said second surface of said engaging portion having a second shape, wherein a portion of said second shape adjacent a distal end of said engaging portion has a width dimension that is greater than a width dimension of a portion of said first shape adjacent said distal end, each of said width dimensions being measured in a direction substantially parallel with said longitudinal edge of said first or second stringer tape, said engaging portion comprising a sealing portion and a fastening portion, said sealing portion and said fastening portion abutting each other at an interface, wherein said sealing portion extends from said first surface of said engaging portion to said interface and said fastening portion extends from said second surface of said engaging portion to said interface, said sealing portion comprises a first engaging face and a second engaging face that each extend between said first surface of said engaging portion and said interface, and said fastening portion comprises a first fastening face and a second fastening face that each extend between said second surface of said engaging portion and said interface, said fastening portion comprises an interface surface that is opposite and spaced apart from said second surface of said engaging portion, said interface surface defining a first groove and a second groove, each groove extending downwardly from said interface surface in a direction substantially toward the second surface of the engaging portion, wherein said first groove is disposed adjacent and extends substantially along at least a portion of said first engaging face of said sealing portion and said second groove is disposed adjacent and extends substantially along at least a portion of said second engaging face of said sealing portion, and a front face disposed at said distal end of said engaging portion and extending between said first and said second surface of said engaging portion; and wherein:

a first gap is defined by said first surfaces of said engaging portions of two adjacent coupling elements in said second set, a second gap is defined by said second surfaces of said engaging portions of said two adjacent coupling elements in said second set, a third gap is defined by said first surfaces of said engaging portions of two adjacent coupling elements in said first set, a fourth gap is defined by said second surfaces of said engaging portions of said two adjacent coupling elements in said first set, when said first set of coupling elements are removably joined together with said second set of coupling elements, said first surface of said engaging portion of a first coupling element in said first set is at least partially disposed within said first gap and said second surface of said engaging portion of said first coupling element is at least partially disposed within said second gap, said first surface of said engaging portion of a second coupling element in said second set is at least partially disposed within said third gap and said second surface of said engaging portion of said second coupling element is at least partially disposed within said fourth gap, said front face of said first coupling element is disposed adjacent and cofacing said longitudinal edge of said second stringer tape, and said front face of said second coupling element is disposed adjacent and cofacing said longitudinal edge of said first stringer tape, and when said first set of coupling elements are removably joined together with said second set of coupling elements and said stringer tapes are bent about said first coupling element and said second coupling element such that said first engaging face of said first coupling element and said first engaging face of said second coupling element are moved toward each other, an edge of an intermediate portion of said first sealing face of said first coupling element is engaged within said first groove of said second coupling element and an edge of an intermediate portion of said first sealing face of said second coupling element is engaged within said first groove of said first coupling element, wherein said intermediate portion of each of said coupling elements is disposed between said first base portion and a distal end portion of said engaging portion, said distal end portion being adjacent said distal end of said engaging portion.

10. The slide fastener of claim 9 wherein said sealing portion of said engaging portion has a first thickness as measured between said first surface of said engaging portion and said interface, said fastening portion of said engaging portion has a second thickness as measured between said second surface of said engaging portion and said interface, and said first thickness is less than said second thickness.

11. The slide fastener of claim 9 wherein said first base portion comprises a first base surface is spaced apart from and above said first surface of said first or second stringer tape and said second surface of said second base portion is spaced apart from and above said second surface of said first or second stringer tape, said first base surface having a first width and said second base surface having a second width, and said first width being greater than said second width.

12. The slide fastener of claim 9 wherein:

said first base portion comprises first and second side surfaces that extend between a first base surface and said first surface of said first or second stringer tape, said first base surface being spaced apart from and above said first surface of said first or second stringer tape, said second base portion comprises first and second side surfaces that extend between a second base surface and said second surface of said first or second stringer tape, said second base surface being spaced apart from and above said second surface of said first or second stringer tape, said first and second side surfaces of said first base portion extend outwardly from said first base surface toward said first surface of said first or second stringer tape at a first angle and said first and second side surfaces of said second base portion extend outwardly from said second base surface toward said second surface of said first or second stringer tape at a second angle, and said first angle is less than said second angle, wherein said first and second angles are measured relative to a vertical axis that extends substantially perpendicularly to said first and second surfaces of said first or second stringer tape.

13. The slide fastener of claim 9 wherein said longitudinal edge of each of said first and second stringer tapes is a first longitudinal edge and each of said first and second stringer tapes further comprise a second longitudinal edge opposite said first longitudinal edge, said second longitudinal edge being configured for attaching to an article such that said first surfaces of said first and second stringer tapes are disposed adjacent an outer surface of said article and said second surfaces of said first and second stringer tapes are disposed adjacent an inner surface of said article.

14. The slide fastener of claim 9 wherein:

said coupling elements further comprise a third coupling element in said first set and a fourth coupling element in said second set, said third coupling element being disposed adjacent said first coupling element on said first stringer tape, and said fourth coupling element being disposed adjacent said second coupling element on said second stringer tape, and said first gap is further defined by said first engaging face of said second coupling element and said second engaging face of said fourth coupling element, said second gap is further defined by said first fastening face of said second coupling element and said second fastening face of said fourth coupling element, said third gap is further defined by said second engaging face of said first coupling element and said first engaging face of said third coupling element, and said fourth gap is further defined by said second fastening face of said first coupling element and said first fastening face of said third coupling element.

15. The slide fastener of claim 9 wherein said fastening portion comprises an interface surface that lies substantially within a plane that comprises said interface, and said fastening portion defines a first chamfered surface and a second chamfered surface, said first chamfered surface extending between said interface surface and said first fastening face and said second chamfered surface extending between said interface surface and said second fastening face.

16. A plurality of coupling elements for use with a slide fastener, each of said coupling elements comprising:

a first base portion disposed adjacent a first surface of a stringer tape and a second base portion disposed adjacent a second surface of said stringer tape, said second surface of said stringer tape being opposite said first surface of said stringer tape, and said first base portion and said second base portion defining a channel therebetween for receiving a longitudinal edge of said stringer tape;

an engaging portion extending outwardly from said first and said second base portions, said engaging portion comprising a first surface and a second surface, said first surface of said engaging portion being opposite and spaced apart from said second surface of said engaging portion, and said first surface of said engaging portion having a first shape and said second surface of said engaging portion having a second shape, wherein a portion of said second surface of said engaging portion adjacent a distal end of said engaging portion has a width dimension that is greater than a width dimension of a portion of said first surface of said engaging portion adjacent said distal end, each of said width dimensions being measured in a direction substantially parallel with said longitudinal edge of said stringer tape, wherein:

said first base portion comprises a first base surface that is spaced apart from and above said first surface of said stringer tape and first and second side surfaces that extend between said first base surface and said first surface of said stringer tape, said second base portion comprises a second base surface that is spaced apart from and above said second surface of said stringer tape and first and second side surfaces that extend between the second base surface and the second surface of said stringer tape, said first base surface having a first width and said second base surface having a second width, wherein said first width is greater than said second width, said first and second side surfaces of said first base portion extend outwardly from said first base surface toward said first surface of said stringer tape at a first angle, and said first and second side surfaces of said second base portion extend outwardly from said second base surface toward said second surface of said stringer tape at a second angle, said first angle being less than said second angle as measured relative to a vertical axis that extends substantially perpendicularly to said first and second surfaces of said stringer tape; and a front face being disposed at said distal end of said engaging portion and extending between said first and said second surfaces of said engaging portion.

17. The coupling elements of claim 16 wherein:

said engaging portion comprises a sealing portion and a fastening portion, and said sealing portion and said fastening portion abut each other at an interface, wherein said sealing portion extends from said first surface of said engaging portion to said interface and said fastening portion extends from said second surface of said engaging portion to said interface, and said sealing portion of said engaging portion has a first thickness as measured between said first surface of said engaging portion and said interface, said fastening portion of said engaging portion has a second thickness as measured between said second surface of said engaging portion and said interface, and said first thickness is less than said second thickness.

18. The coupling elements of claim 16 wherein:

said engaging portion comprises a sealing portion and a fastening portion, and said sealing portion and said fastening portion abut each other at an interface, wherein said sealing portion extends from said first surface of said engaging portion to said interface and said fastening portion extends from said second surface of said engaging portion to said interface, said sealing portion comprises a first engaging face and a second engaging face that each extend between said first surface of said engaging portion and said interface, and said fastening portion comprises a first fastening face and a second fastening face that each extend between said second surface of said engaging portion and said interface, and said fastening portion comprises an interface surface opposite and spaced apart from said second surface of said engaging portion, said interface surface defining a first groove and a second groove, each groove extending downwardly from said interface surface in a direction substantially toward said second surface of said engaging portion, wherein said first groove is disposed adjacent and extends substantially along at least a portion of said first engaging face of said sealing portion and said second groove is disposed adjacent and extends substantially along at least a portion of said second engaging face of said sealing portion.

19. The coupling elements of claim 16 wherein:

said first shape comprises a substantially trapezoidal shaped distal end portion and a substantially trapezoidal shaped intermediate portion, said distal end portion being disposed adjacent said distal end of said engaging portion and said intermediate portion being disposed between said distal end portion and said first base portion, and a width of a base of said intermediate portion is greater than a width of a base of said distal end portion.

20. The coupling elements of claim 16 wherein:

said engaging portion comprises a sealing portion and a fastening portion, and said sealing portion and said fastening portion abut each other at an interface, wherein said sealing portion extends from said first surface of said engaging portion to said interface and said fastening portion extends from said second surface of said engaging portion to said interface, said sealing portion comprises a first engaging face and a second engaging face that each extend between said first surface of said engaging portion and said interface, and said fastening portion comprises a first fastening face and a second fastening face that each extend between said second surface of said engaging portion and said interface, said first and second fastening faces being spaced apart from each other, and said fastening portion comprises an interface surface that lies substantially within a plane that comprises said interface, and said fastening portion defines a first chamfered surface and a second chamfered surface, said first chamfered surface extending between said interface surface and said first fastening face and said second chamfered surface extending between said interface surface and said second fastening face.

21. The coupling elements of claim 3, wherein the first and second surfaces of the intermediate portion are disposed between a narrowest portion of the neck portion and the widest portion of the head portion.

* * * * *